US005188014A

United States Patent [19]

Simson

[11] Patent Number: 5,188,014

[45] Date of Patent: Feb. 23, 1993

[54] HYDRAULIC CYLINDER WITH PRESSURE TRANSMISSION

[76] Inventor: Dionizy Simson, Oberseenerstrasse 78, 8405 Winterthur, Switzerland

[21] Appl. No.: 835,089

[22] Filed: Feb. 18, 1992

Related U.S. Application Data

[63] Continuation of Ser. No. 652,669, Feb. 8, 1991, abandoned.

[30] Foreign Application Priority Data

Feb. 14, 1990 [CH] Switzerland ..... 476/90

[51] Int. Cl.[5] ..... F01B 25/04

[52] U.S. Cl. ..... 91/10; 91/8; 91/6; 60/560; 60/563; 60/593; 92/65; 92/75

[58] Field of Search ..... 92/61, 62, 65, 75, 110, 92/113, 150, 151, 181 R, 181 P, 165 PR; 60/560, 563, 565, 583, 593; 91/165, 6, 166, 436, 170, 173, 167 R, 8, 10

[56] References Cited

U.S. PATENT DOCUMENTS

| | | | |
|---|---|---|---|
| 1,181,110 | 5/1916 | Carter | 92/65 |
| 2,575,937 | 11/1951 | Bent | 91/167 R |
| 3,021,802 | 2/1962 | Glas | 60/563 |
| 3,410,089 | 11/1968 | Snitgen . | |
| 4,620,419 | 11/1986 | Simson | 60/563 |

FOREIGN PATENT DOCUMENTS

| | | | |
|---|---|---|---|
| 164334 | 12/1985 | European Pat. Off. . | |
| 1296522 | 5/1969 | Fed. Rep. of Germany . | |
| 2741509 | 3/1978 | Fed. Rep. of Germany . | |
| 7729 | of 1888 | United Kingdom . | |
| 0009571 | of 1896 | United Kingdom | 92/65 |
| 1600733 | 10/1981 | United Kingdom | 60/563 |

*Primary Examiner*—Thomas E. Denion

*Attorney, Agent, or Firm*—Oblon, Spivak, McClelland, Maier & Neustadt

[57] ABSTRACT

The hydraulic cylinder comprises a cylinder jacket (1), a piston-rod guide flange (2), and a cylinder bottom (3). Disposed within the cylinder are a primary piston (4) provided with a piston rod (6) and a secondary piston (11) connected to two plungers (7, 8). The plungers enter two bores (5, 6) in the primary piston. Two spring-biased (19, 20), openable check valves (17, 18) are disposed in the cylinder bottom. In each valve there is a bore (41, 42) connecting the front and rear sides of the valve. The rear portions (24, 25) of the valve chambers (26, 27) each contain a spherical unstopping piston (21, 22). Two supply ducts (23, 30) for the hydraulic fluid are connected to the valve chambers, these chambers in turn having supply ducts at various locations (36, 40, 45) of the interior of the cylinder. A very compact construction is possible for the hydraulic cylinder with pressure transmission.

13 Claims, 4 Drawing Sheets

HYDRAULIC CYLINDER WITH PRESSURE TRANSMISSION

Figure 1:
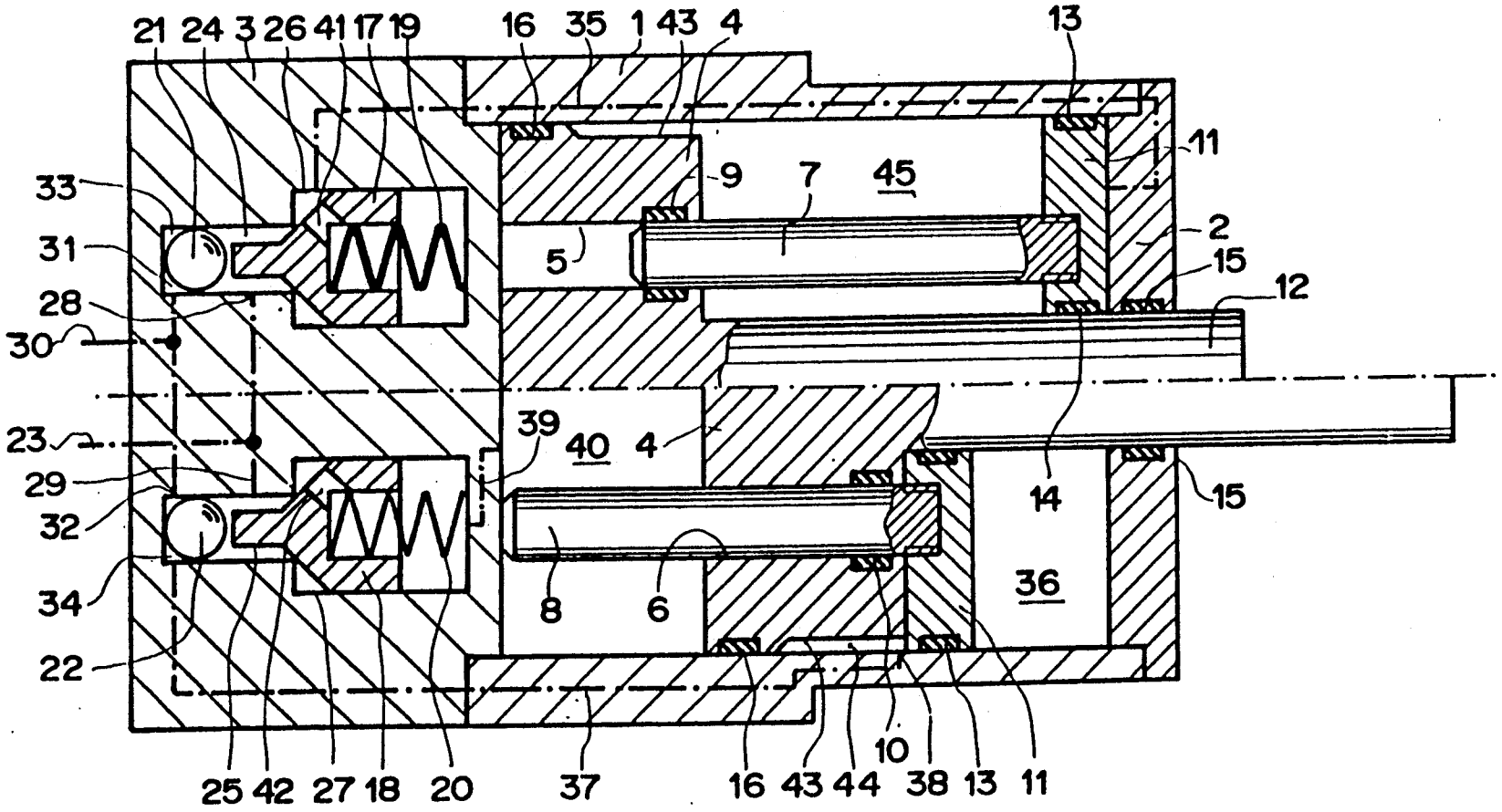

This application is a continuation of application Ser. No. 07/652,669, filed on Feb. 8, 1991, now abandoned.

This invention relates to hydraulic equipment, and more particularly to a hydraulic cylinder with pressure transmission of the type having a cylinder jacket, a piston-rod guide flange, a cylinder bottom, a primary piston provided with a piston rod, and a secondary piston.

Hydraulic cylinders are needed which produce strong forces while being compact and light. Such cylinders are used for pile driving in underground structural work, as well as in punching and stamping operations, and as chucking elements in machine tools and robotics.

Prior art designs, e.g., as disclosed in European Patent No. 0 164 334, have an internally stepped cylinder jacket or a partition in a tandem arrangement. This construction lengthens the cylinder considerably and also increases production costs accordingly. Operation of such a cylinder when there is no fixed stop leads to its damage since either supply-line bores are run over by gaskets and thus destroyed, or the guide flange of the piston rod is ripped off.

It is an object of this invention to provide an improved hydraulic cylinder with pressure transmission which is so designed that the aforementioned shortcomings are avoided while making possible a compact construction of the hydraulic cylinder.

A further object of this invention is to provide such a hydraulic cylinder which can be used without steps, thus leading to a considerable saving on costs.

To this end, in one aspect of the hydraulic cylinder according to the present invention, of the type initially mentioned, the primary piston is provided with at least two bores into which at least two plungers connected to the secondary piston penetrate.

In another aspect of the hydraulic cylinder according to the present invention, likewise of the type initially mentioned, the primary piston is multistepped and is traversed by an axial duct.

Since the piston rod of the primary piston passes through the secondary piston, and in the case of the construction with plungers, the latter in turn pass through the primary piston, only a minimal length is required.

Preferred embodiments of the invention will now be described in detail with reference to the accompanying drawings, in which FIGS. 1–4 are respective sections through four embodiments of the inventive hydraulic cylinder with pressure transmission.

A cylinder 1 is closed off at one end by a piston-rod guide flange 2 and at the other end by a cylinder bottom 3. A primary piston 4 is provided with two bores 5 and 6 into which two plungers 7 and 8 penetrate. Bores 5 and 6 are provided with gaskets 9 and 10. Plungers 7 and 8 are rigidly connected to an annular secondary piston 11. Secondary piston 11 is guided on the piston rod 12 of primary piston 4 and is movably sealed relative to cylinder 1 and piston rod 12 by gaskets 13 and 14. There is likewise a gasket 15 in piston-rod guide flange 2 for sealing piston rod 12 relative to flange 2. Primary piston 4 is likewise provided with a gasket 16 at the end thereof remote from piston rod 12. The primary and secondary pistons are illustrated in the upper half of FIG. 1 in a first position and in the lower half in a second position. Cylinder bottom 3 includes two openable check valves 17 and 18, valve 17 being biased by a strong spring 19 and valve 18 by a weak spring 20. Check valves 17 and 18 are opened by means of two spherical unstopping pistons 21 and 22. At locations 28 and 29, situated between check valves 17 and 18 and unstopping pistons 21 and 22, a supply duct 23 for the fluid opens into the two narrower regions 24 and 25 of check-valve chambers 26 and 27. Another supply duct 30 for the fluid opens at locations 31 and 32 into the regions 33 and 34 of check-valve chambers 26 and 27, behind unstopping pistons 21 and 22, and connects the two chambers. A further duct 35 connects chamber 26 to the space 36 between secondary piston 11 and piston-rod guide flange 2. A fourth duct 37 connects portion 34 of check-valve chamber 27 to a discharge location 38 into cylinder jacket 1. A fifth duct 39 connects check-valve chamber 27 to the space 40 between cylinder bottom 3 and primary piston 4. In check valves 17 and 18 there are bores 41 and 42 which connect the front and rear sides of the valves. On primary piston 4 or on secondary piston 11 or on both there is a shoulder 43 so that a gap is formed between the outer surface of the primary piston and/or the secondary piston and cylinder jacket 1.

The mode of operation of the hydraulic cylinder of FIG. 1 will now be explained. The two pistons 4 and 11 are in their starting positions as shown in the upper half of FIG. 1. As soon as the hydraulic pressure in duct 23 starts to increase, check valve 18 having the weak spring 20 opens, so that the pressure fluid can flow through bore 42 and duct 39 into chamber 40. Primary piston 4 moves until it encounters a firm resistance. The flow of pressure fluid is interrupted for a short time, whereupon check valve 18 having the weak spring 20 closes, and through the increasing pressure check valve 17 having the strong spring 19 is opened. The pressure fluid flows through duct 35 into chamber 36, as a result of which secondary piston 11 starts to move, and plungers 7 and 8 enter bores 5 and 6 of primary piston 4. The ratio between the pressure-impinged areas of secondary piston 11 and plungers 7 and 8 is such that a hydraulic transmission occurs. As a result of the penetration of plungers 7 and 8 into bores 5 and 6, the pressure of the pressure fluid in chamber 40 increases in accordance with the hydraulic transmission. Primary piston 4 moves forward with increased force until the resistance reaches the same magnitude as the force produced. In this case, neither primary piston 4 nor secondary piston 11 reaches its end position. The pressure in the supply line is equalized, check valve 17 closes, and the supply of hydraulic fluid can be cut off. The pressure attained remains steady.

In order to return the two pistons to the starting position, the pressure in duct 30 is increased, so that unstopping pistons 21 and 22 of check valves 17 and 18 open. The pressure fluid thus flows through duct 37 into chamber 45 and forces primary piston 4 and secondary piston 11 back into their starting positions. The pressure fluid can escape from chambers 36 and 40 without pressure through ducts 35, 39, and 23.

If primary piston 4 does not meet with any firm resistance during its advance, it comes up against secondary piston 11, so that the latter can then not carry out any movement, and the increase in pressure is not initiated. In this case, only the primary force acts upon piston-rod guide flange 2, and the latter cannot be ripped off.

Shoulder 43 on primary piston 4 or secondary piston 11 ensures that mouth 38 of duct 37 is not covered up by a gasket, and that a hydraulic communication with chamber 45 is constantly maintained by means of shoulder 43. If primary piston 4 meets with a yielding resistance during its advance, the transmission operation is initiated, but the maximum force is not attained since secondary piston 11 butts against cylinder bottom 3 via plungers 7 and 8 after carrying out its stroke. At this time mouth 38 of duct 37 is also not run over, and the gaskets are not destroyed. This position is shown in the lower half of FIG. 1.

Figure 2:
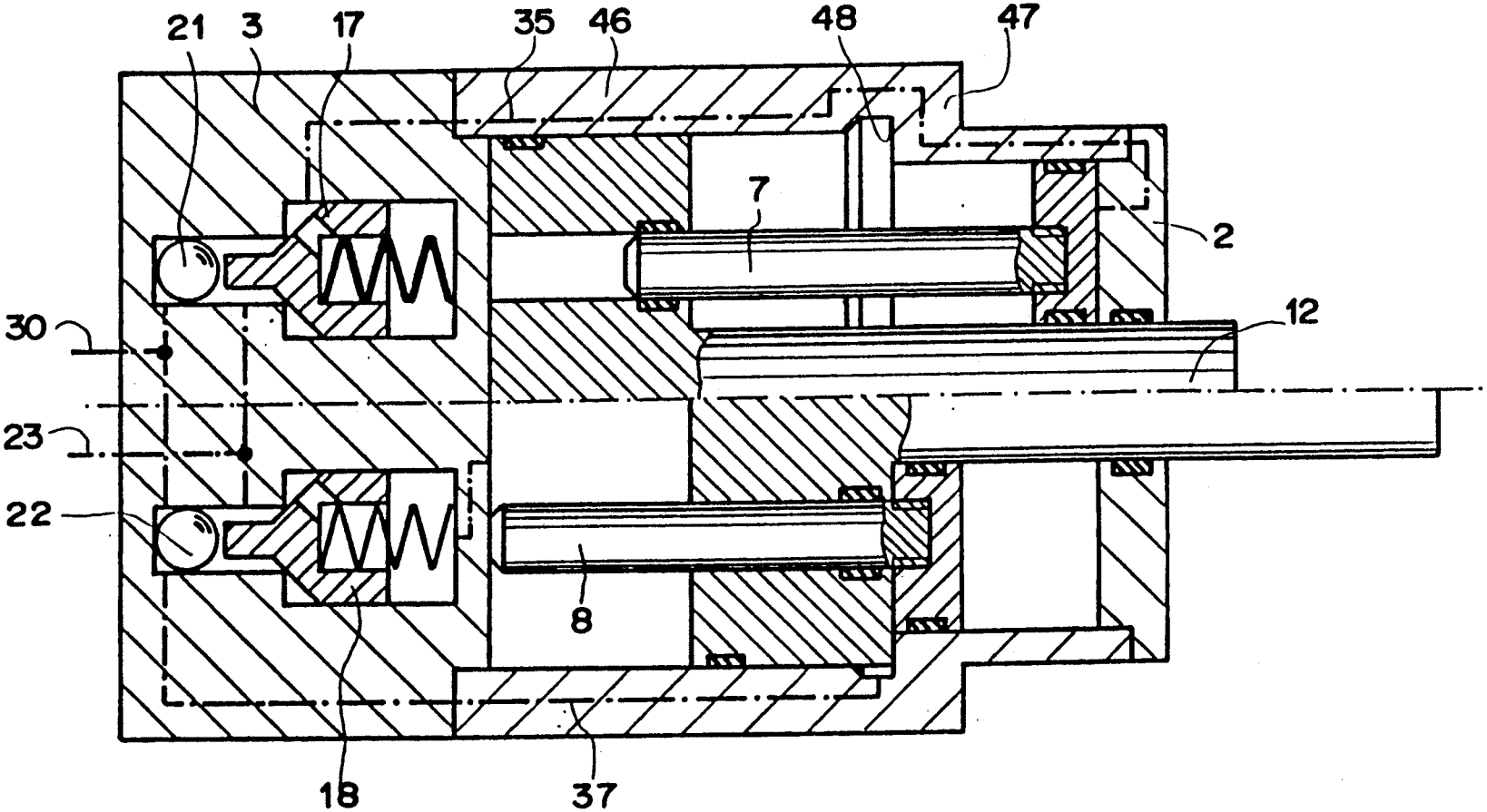

In the embodiment of FIG. 2, a cylinder jacket 46 has a shoulder 47, forming a solid stop 48 for the primary piston.

Figure 3:
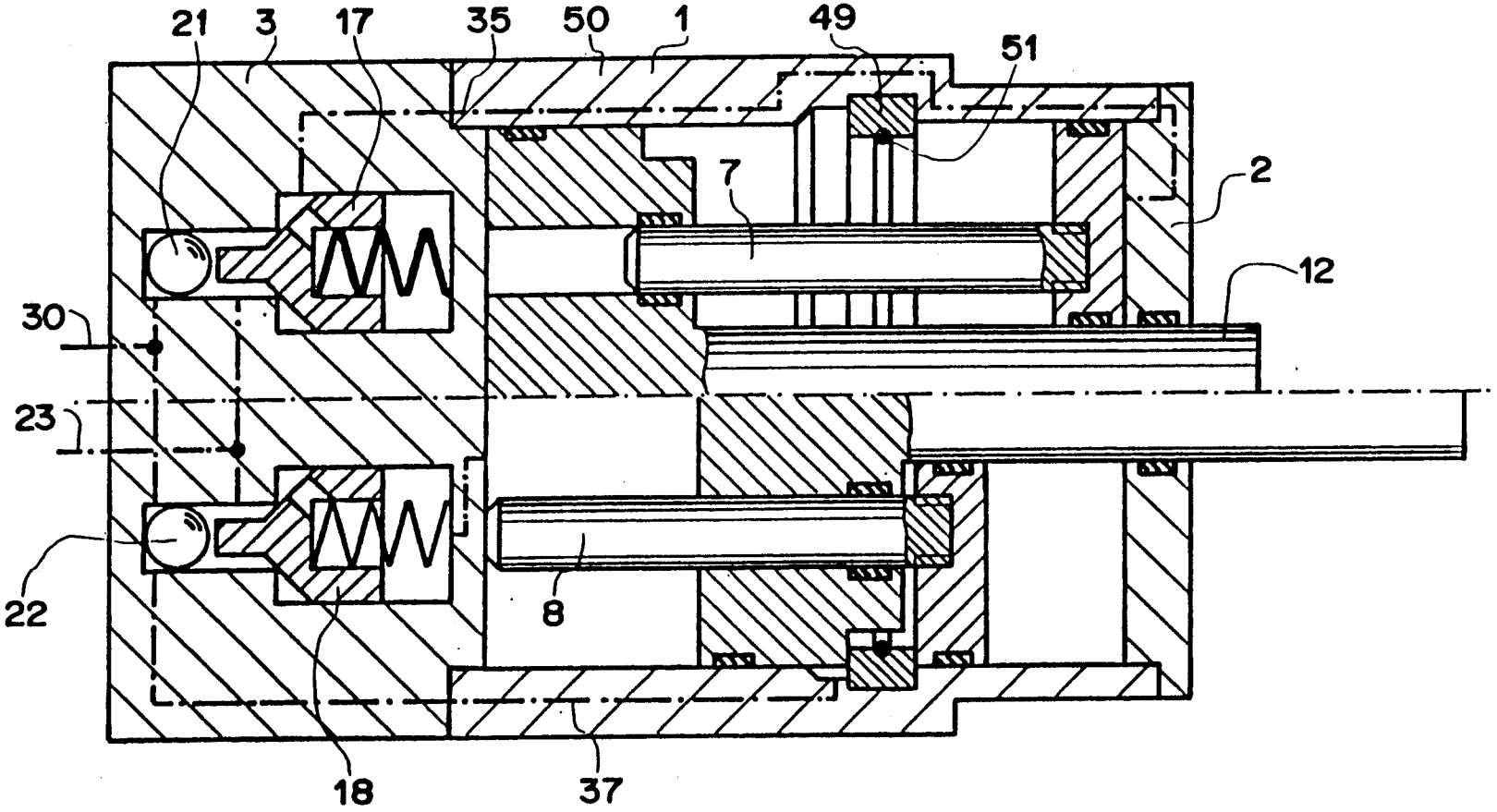

In the embodiment of FIG. 3, the stop for the primary piston is formed by a split ring 49 within a cylinder jacket 50, ring 49 being spread apart by means of a spring washer 51. The designs illustrated in FIGS. 2 and 3 are less advantageous than that of FIG. 1 inasmuch as the transmitted force does occur upon execution of the stroke and must then be absorbed at some inconvenience (additional stop 48 in the case of FIG. 2, additional ring assembly 49/51 in the case of FIG. 3). In the embodiments of FIGS. 2 and 3 as well, the different positions of the pistons are each shown in the upper and lower halves of the drawing. The mode of operation of these embodiments is the same as that of FIG. 1.

Figure 4:
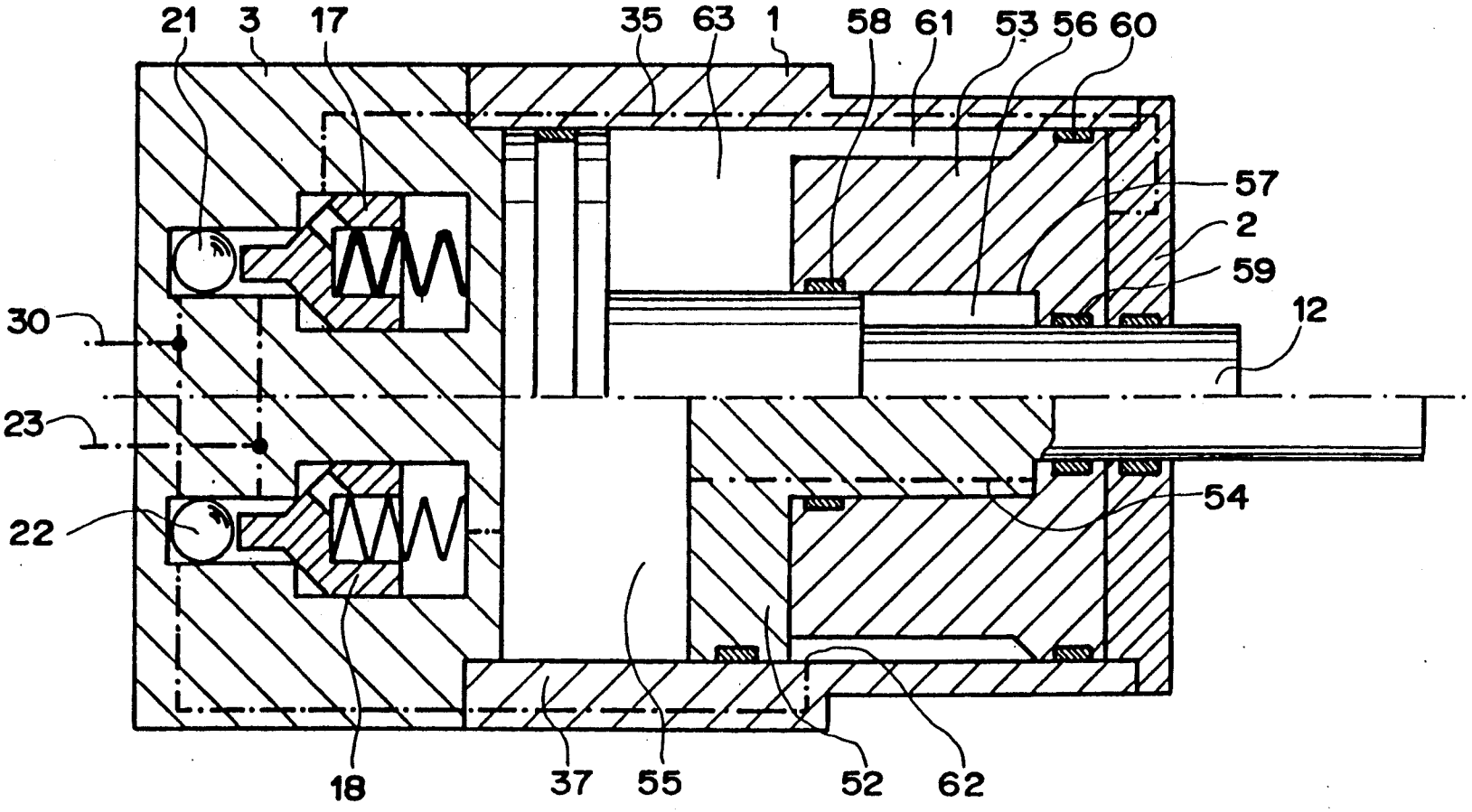

In the embodiment of FIG. 4, a primary piston 52 has no axial bores, and a secondary piston 53 has no plungers. In this embodiment, the primary piston is three-stepped and has an axial duct 54 connecting a chamber 55 to a chamber 56. Secondary piston 53 has a two-stepped bore 57 provided at both ends with gaskets 58, 59, and 60. A shoulder 61 on the secondary piston ensures that hydraulic communication exists continuously between a duct mouth 62 and a chamber 63. The function is the same as in the embodiment of FIG. 1, i.e., upon maximum extension of primary piston 53, hydraulic transmission cannot occur at all. In the embodiment of FIG. 4, too, different positions of the pistons are shown in the upper and lower halves of the drawing.

The embodiments of FIGS. 1 and 4 prevent the occurrence of strong internal forces which must subsequently be absorbed. The possibility of using commercially available non-stepped cylinder jackets in the embodiments of FIGS. 1, 3, and 4 allows a considerable reduction in manufacturing costs. By disposing the check valves in the cylinder bottom, the high-pressure region is confined to just one space, and its size is determined only by the stroke of the primary piston. In the low-pressure portion, in the region of the secondary piston, the cylinder jacket may be tapered, which is desirable above all for use as a clamping cylinder in underground structural work since the clamping body may then be designed more solidly. The embodiment of FIG. 4 is particularly suitable for small-diameter cylinders for robotics.

What is claimed is:

1. A hydraulic cylinder with pressure transmission comprising:

a cylinder jacket;

a piston-rod guide flange;

a cylinder bottom;

a primary piston having at least two bores;

a piston rod associated with said primary piston;

a secondary piston;

at least two plungers, each connected at one end thereof to said secondary piston and each having a free end adapted respectively to enter a corresponding one of said at least two bores;

a first chamber defined by said cylinder bottom, said cylinder jacket and said primary piston;

a first supply duct for introducing hydraulic fluid into said first chamber;

a second chamber defined between said secondary piston and said guide flange;

a second supply duct for introducing hydraulic fluid into said second chamber;

an intermediate chamber defined between said primary piston and said secondary piston; and a third supply duct for introducing hydraulic fluid into said intermediate chamber.

2. A hydraulic cylinder with pressure transmission according to claim 1, wherein hydraulic fluid in said first chamber exerts a force on said free end of each of said at least two plungers, and wherein hydraulic fluid in said second chamber exerts an opposing force on said secondary piston.

3. A hydraulic cylinder with pressure transmission according to claim 2, wherein a pressure-impinged area of said secondary piston is large in comparison to a pressure-impinged area of said at least two plungers, such that a hydraulic transmission occurs when pressures in said first and second chambers are equal.

4. A hydraulic cylinder with pressure transmission comprising:

a cylinder jacket;

a piston-rod guide flange;

a cylinder bottom;

a multistepped primary piston;

an axial duct traversing said primary piston;

a piston rod associated with said primary piston;

a secondary piston having a bore therethrough slidably receiving said piston rod;

a first seal provided between said primary piston and said cylinder jacket;

a second seal provided between one step of said primary piston and said secondary piston; and a third seal provided between another step of said primary piston and said secondary piston.

5. The hydraulic cylinder of claim 2, wherein said bore in said secondary piston includes a two-stepped axial bore, said second seal being disposed at one end of said axial bore, and said third seal being formed at an opposite end of said axial bore, such that a chamber is formed between the outside of said primary piston and the inside of said secondary piston.

6. A hydraulic cylinder with pressure transmission comprising:

a cylinder jacket;

a piston-rod guide flange;

a cylinder bottom;

a primary piston having at least two bores;

a piston rod associated with said primary piston;

a secondary piston;

at least two plungers connected to said secondary piston and adapted respectively to enter said two bores;

two check valves disposed in said cylinder bottom, two springs respectively biasing said check valves, and means for opening said check valves.

7. The hydraulic cylinder of claim 6, wherein said two springs have different elasticity constants.

8. The hydraulic cylinder of claim 6, wherein each of said check valves includes a bore connecting the front and rear sides of the respective check valve.

9. The hydraulic cylinder of claim 7, wherein each of said check valves includes a bore connecting the front and rear sides of the respective check valve.

10. The hydraulic cylinder of claim 6, wherein each of said check valves includes a valve chamber, further comprising a space bounded by said piston-rod guide flange and said secondary piston and a first duct connecting said space to a first said valve chamber.

11. The hydraulic cylinder of claim 6, wherein each of said check valves includes a valve chamber, further comprising a space bounded by said cylinder bottom and said primary piston and a second duct connecting said space to a second said valve chamber.

12. The hydraulic cylinder of claim 10, wherein said primary piston includes a circumferential shoulder, further comprising two unstopping pistons disposed in respective valve-chamber portions, a space bounded by said cylinder jacket and said shoulder, and a third duct connecting said valve-chamber portions and opening into said space.

13. The hydraulic cylinder of claim 11, wherein said primary piston includes a circumferential shoulder, further comprising two unstopping pistons disposed in respective valve-chamber portions, a space bounded by said cylinder jacket and said shoulder, and a third duct connecting said valve-chamber portions and opening into said space.

* * * * *